US005863216A

United States Patent [19]

Tsuji et al.

[11] Patent Number: 5,863,216

[45] Date of Patent: Jan. 26, 1999

[54] SHORT-CIRCUITING TERMINAL FITTING AND CONNECTOR THEREFOR

[75] Inventors: Takeshi Tsuji, Yokkaichi; Kouichi Shirouzu, Aichi-ken, both of Japan

[73] Assignee: Sumitomo Wiring Systems, Ltd., Japan

[21] Appl. No.: 898,698

[22] Filed: Jul. 24, 1997

[30] Foreign Application Priority Data

Jul. 25, 1996 [JP] Japan ..... 8-196743

[51] Int. Cl.[6] ..... H01R 3/00

[52] U.S. Cl. ..... 439/489

[58] Field of Search ..... 439/66, 188, 489, 439/490

[56] References Cited

U.S. PATENT DOCUMENTS

| | | | |
|---|---|---|---|
| 5,213,513 | 5/1993 | Brown et al. . | |
| 5,562,486 | 10/1996 | Saijo et al. . | |
| 5,655,913 | 8/1997 | Castaneda et al. | 439/66 |
| 5,667,403 | 9/1997 | Fukuda et al. | 439/489 |

FOREIGN PATENT DOCUMENTS 7-201414 of 1995 Japan .

2 285 714 of 1995 United Kingdom .

*Primary Examiner*—Neil Abrams
*Assistant Examiner*—Javaid Nasri
*Attorney, Agent, or Firm*—Anthony J. Casella; Gerald E. Hespos; Ludomir A. Budzyn

[57] ABSTRACT

A short-circuit terminal fitting 30 is provided with a protection wall 35 to prevent deformation of elastic contact portions due to interference by other members and to prevent excessive deformation of the elastic contact portions due to an excessive pressing displacement of a lock arm. The protection wall 35 is so formed as to surround the leading free ends of elastic contact portions 32 which are fixed at one end thereof and hanging at the other end thereof. When the short-circuiting terminal fitting 30 is handled alone, the elastic contact portions 32 are unlikely to be interfered with by other members since they are surrounded by the protection wall 35 and, accordingly, the deformation of the elastic contact portions 32 due to interference by other members can be prevented. Further, the protection wall 35 prevents deformation of the elastic contact portions 32 that otherwise could be caused by a lock arm 21 engaging the elastic contact portion 32 when the fitting 30 is mounted in a female connector housing 20.

11 Claims, 6 Drawing Sheets

SHORT-CIRCUITING TERMINAL FITTING AND CONNECTOR THEREFOR

BACKGROUND OF THE INVENTION

1. Field of the Invention

The present invention relates to a short-circuiting terminal fitting for detecting an engaged state of a connector and a connector provided with an engagement detecting function comprising such a short-circuit terminal fitting.

2. Description of the Prior Art

A known connector provided with an engagement detecting function is disclosed in Japanese Unexamined Patent Publication No. 7-201414. This connector is constructed, as shown in FIG. 8, such that a connector housing 1 is provided with a lock arm 2 and a short-circuiting terminal fitting 3 provided with elastic contact portions 4 is mounted in the connector housing 1. When this connector is partly engaged with a mating connector housing 5, as shown in FIG. 8, a projection 6 formed on the lock arm 2 is in contact with an engaging portion 7 of the mating connector housing 5, thereby being elastically deformed downward. The elastic contact portions 4 pressed by the lock arm 2 are displaced to positions where they are not in contact with a pair of detection terminals 8 provided in the mating connector housing 5. In this state, since the detection terminals 8 are not short-circuited, the partial engagement of the connector housings 1, 5 is detected. Further, when the connector housing 1 is properly engaged with the mating connector housing 5, the projection 6 having passed the engaging portion 7 is lockingly engaged with the edge of the engaging portion 7 by the elastic restoring force of the lock arm 2 and, not being pressed by the lock arm 2 any longer, the elastic contact portions 4 elastically return to their original upper positions to contact and short-circuit the detection terminals 8. As a result, the proper engagement of the connector housings 1, 5 is detected.

As shown in FIG. 9, the elastic contact portions 4 of the short-circuiting terminal fitting 3 are fixed at one end thereof and hanging or deflectable at the other end thereof in order to facilitate its elastic deformation. Thus, when the short-circuiting terminal fitting 3 is handled alone, the elastic contact portions 4 may come into contact with and/or get caught with other members or elastic contact portions 4 of another short-circuiting terminal fitting 3. This may cause the deformation of the elastic contact portion 4. Further, when the short-circuiting terminal fitting 3 is mounted in the connector housing 1, the elastic contact portions 4 project into a space for the insertion of the short-circuiting terminal fitting 3 which is open in the rear end surface of the connector housing 1. Accordingly, if a foreign matter or the like enters this space, the elastic contact portions 4 may be deformed. Furthermore, if, due to a contact with a foreign matter or other reason, the lock arm 2 is excessively deformed beyond its usual degree of displacement when the connector housings 1, 5 are partly engaged, the elastic contact portions 4 may be excessively deformed beyond their elasticity limit.

The present invention was developed in view of the above problems and an object thereof is to prevent the deformation of an elastic contact portion due to the interference by other member(s) and an excessive deformation of the elastic contact portion due to an excessive pressing displacement of a lock arm.

SUMMARY OF THE INVENTION

According to the invention, there is provided a short-circuiting terminal fitting which is mountable in one of a pair of connector housings. The short-circuiting terminal is provided with an elastic contact portion which is deflectable at an end thereof by a deflection means provided in one connector housing. The elastic contact portion can be brought out of contact with at least a pair of detection terminals by being deflected by the deflection means when the pair of connector housings are partly engaged. The elastic contact portion can short-circuit the detection terminals by being released from the deflection by the deflection means and by coming into contact with the detection terminals when the connector housings are properly engaged. Thus an engaged state of the pair of connector housings can be detected based on a short-circuited state of the detection terminals.

A protection wall is provided substantially around the deflectable or hanging end of the elastic contact portion. Since the elastic contact portion is surrounded by the protection wall, it is unlikely to be interfered by other member (s) and, accordingly, its deformation due to the interference by the other member(s) can be prevented.

According to a preferred embodiment of the invention, the deflection means comprises a lock arm, which locks the pair of connector housings in their engaged state, wherein the elastic contact portion is operable together with the lock arm and is deflected by being pressed by the lock arm.

Preferably, the protection wall prevents an excessive deformation of the elastic contact portion by being brought into contact with the deflection means, in particular the lock arm, when the deflection means is moved, in particular the lock arm is pressingly displaced. Thus the protection wall forms deflection limiting means.

Further preferably, the elastic contact portion is folded back from one end of a substantially flat platelike base portion toward the other end thereof, and the protection wall stands at substantially the periphery of the other end of the base portion.

The deflection means, in particular the lock arm, may comprise an inclination or displacement preventing portion for preventing an inclination or displacement of the deflection means along a coupling or insertion direction of the connector housings and/or in a direction substantially normal to the coupling direction of the connector housings by coming into contact with the protection wall. The inclination preventing portion preferably comprises a step and/or a recess provided in the deflection means, in particular in the lock arm.

Accordingly the deflection means, in particular the lock arm, cannot be further displaced, when the deflection means reaches the protection wall, due to the wedging or locking with the inclination preventing portion. Thus an excessive deformation of elastic contact portions due to the pressing displacement of the deflection means, in particular of a lock arm is prevented Most preferably, a deflectable or distal end of the elastic contact portion comprises a rear bent surface obliquely inclined such that a force generated by a member other than the deflection means contacting the deflectable end from behind with respect to a coupling direction of the connector housings, is diverted.

According to the invention, there is further provided a connector with an engagement detecting function, comprising at least a pair of connector housings that are engageable with each other. At least a pair of detection terminals are provided in one housing. A short-circuit terminal fitting, is provided with an elastic contact portion which is fixed at one end thereof and hanging or deflectable at the other end thereof by a deflection means provided in one connector housing. The short-circuit terminal is brought out of contact with the detection terminals by the elastic contact portion being deflected by the deflection means when the pair of connector housings are partly engaged and short-circuits the detection terminals by the elastic contact portion released from the deflection by the deflection means and coming into contact with the detection terminals when the connector housings are properly engaged, so that an engaged state of the pair of connector housings can be detected based on a short-circuited state of the detection terminals, wherein a protection wall is provided substantially around the leading or deflectable end of the elastic contact portion.

According to a preferred embodiment, the detection terminals are supported in one connector housing and reinforced by a rib projecting from the connector housing and arranged along at least a portion of the detection terminals.

Preferably, the deflection means of the one connector housing comprises a lock arm capable of interacting with a lock projection or recess of the other connector housing and locking the connector housings in their engaged state, wherein the lock arm is preferably deflectable or deformable in a deformation permitting space provided in the one connector housing.

According to a further preferred embodiment, there is provided a short-circuiting terminal fitting which is mountable in one of a pair of connector housings to be locked in their engaged state by a lock arm; is provided with an elastic contact portion which is operable together with the lock arm, fixed at one end thereof and hanging at the other end thereof; is brought out of contact with a pair of detection terminals by the elastic contact portion being pressed by the lock arm when the pair of connector housings are partly engaged and short-circuits the detection terminals by the elastic contact portion released from the pressing by the lock arm and coming into contact with the detection terminals when the connector housings are properly engaged so that an engaged state of the pair of connector housings can be detected based on a short-circuited state of the detection terminals, wherein a protection wall is provided around the leading end of the elastic contact portion.

Preferably, the protection wall prevents an excessive deformation of the elastic contact portion by being brought into contact with the lock arm when the lock arm is pressingly displaced.

Accordingly, if the lock arm is excessively pressingly displaced beyond its usual degree of displacement while the short-circuiting terminal fitting is mounted in the connector housing, any further deformation of the lock arm is prevented by being brought into contact with the protection wall. Thus, an excessive deformation of the elastic contact portion can be prevented.

Most preferably, the elastic contact portion is folded back from one end of a flat platelike base portion toward the other end thereof and the protection wall stands at the periphery of the other end of the base portion.

Accordingly, since the protection wall stands on the base portion, the strength of the protection is higher as compared with a case where the protection wall is fixed at one end and hanging at the other end. Further, since the base portion is flat platelike, when the short-circuiting terminal fitting is inserted into a receptacle therefor, it can be held in a stable configuration by sliding the base portion along an inner wall of the receptacle. Accordingly, the short-circuiting terminal fitting can be easily inserted.

These and other objects, features and advantages of the present invention will become more apparent upon a reading of the following detailed description and accompanying drawings.

DETAILED DESCRIPTION OF THE PREFERRED EMBODIMENTS

Figure 1:
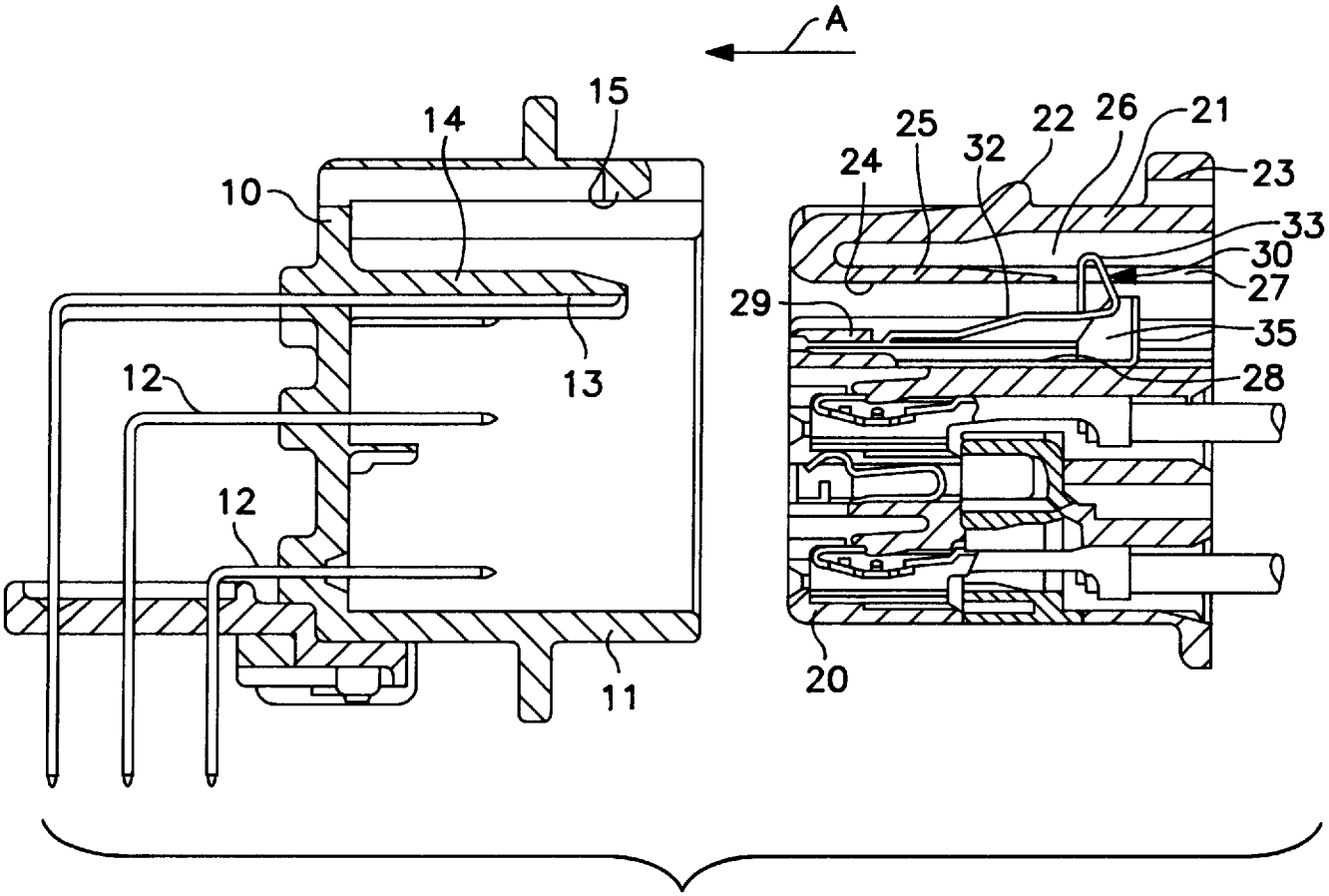
FIG. 1 is a section of a first embodiment of the invention before connector housings are engaged.

With reference to FIGS. 1 to 6, a connector housing 10 for a circuit board which is formed with a hood 11 having an open front surface. A plurality of preferably L-shaped terminals 12 are so mounted that their leading ends project into the hood 11. Two terminals 12 located in uppermost positions in the hood 11 act as detection terminals 13 which enable short-circuiting by a short-circuiting terminal fitting 30 to be described later. These detection terminals 13 are reinforced by a rib 14 arranged along the upper surfaces thereof. On the upper wall of the hood 11 is formed a lock portion 15 to be engaged with a lock arm 21 of a female connector housing 20 to be described later.

The female connector housing 20 is fittable or insertable into the connector housing 10. The female connector housing 20 is formed with the lock arm 21 which is folded back at an upper edge of the front end surface of the female connector housing 20 to extend rearwardly. This lock arm 21 is inserted along the upper wall of the hood 11 when the connector housings 10 and 20 are engaged. On the upper surface of the lock arm 21 is formed a projection 22 engageable with the lock portion 15 of the hood 11.

Figure 3:
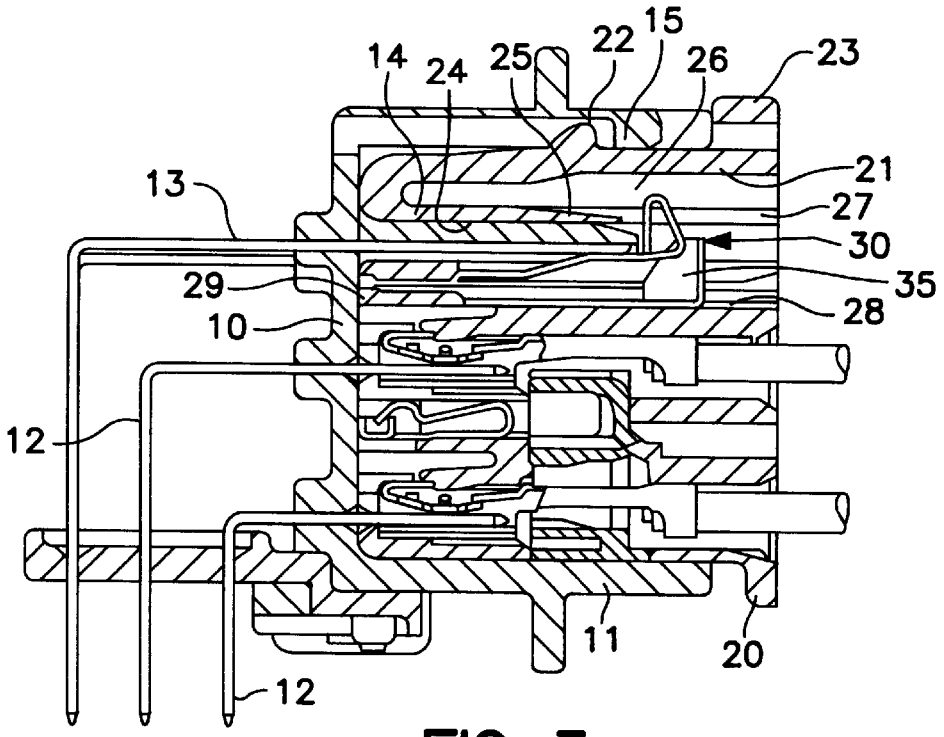
FIG. 3 is a section of the first embodiment when the connector housings are properly engaged.
Figure 4:
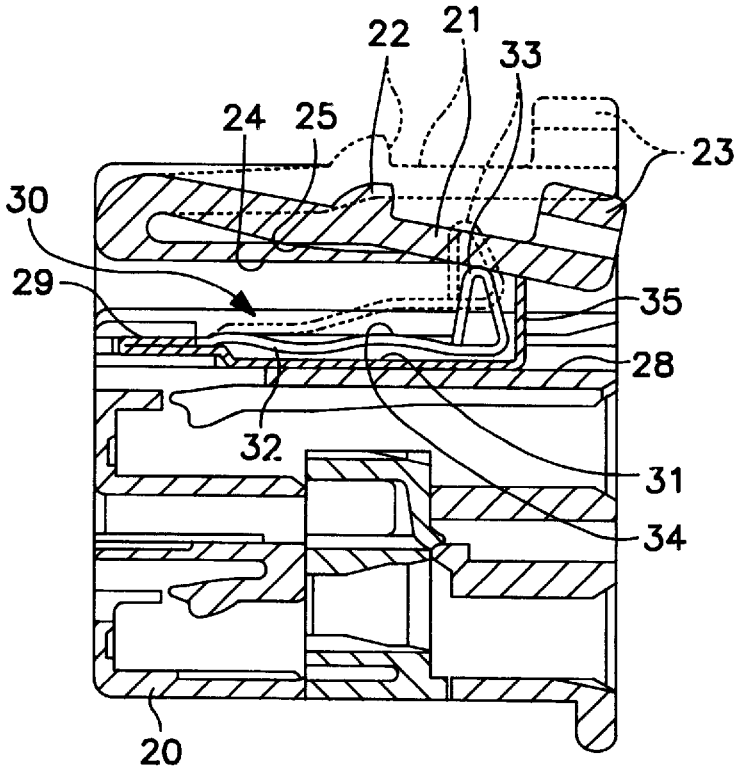
FIG. 4 is a section showing a state of the first embodiment where an excessive deformation of elastic contact portions due to the pressing displacement of a lock arm is prevented.
Figure 5:
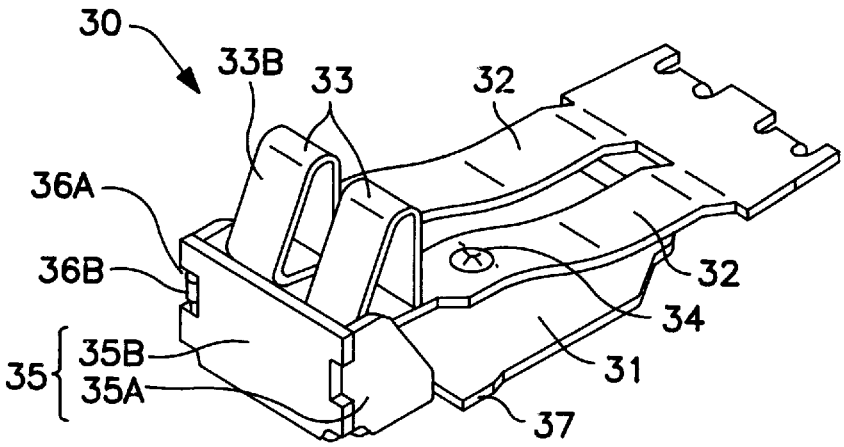
FIG. 5 is a perspective view of a short-circuiting terminal fitting according to the first embodiment.
Figure 6:
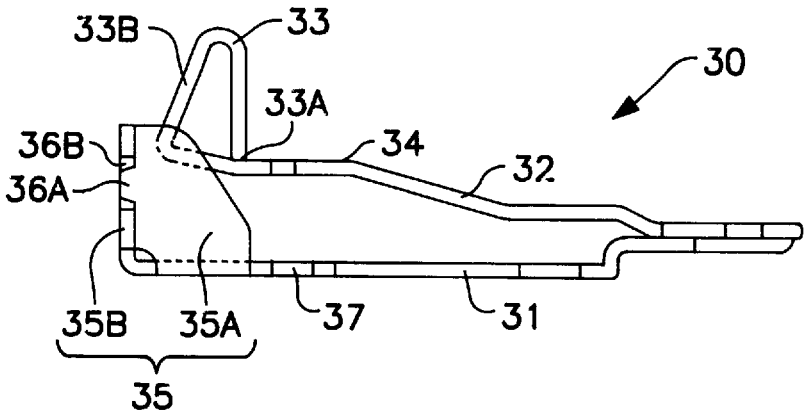
FIG. 6 is a side view of the short-circuiting terminal fitting according to the first embodiment.

In a partly engaged state of the connector housings 10, 20 immediately before they are properly engaged, the projection 22 engages the lower surface of the lock portion 15, thereby elastically deforming the lock arm 21 downwardly. When the connector housings 10, 20 are properly engaged, as shown in FIG. 3, the projection 22 passes the lower surface of the lock portion 15, with the result that the lock arm 21 returns to its original upper position due to its elastic restoring force and the projection 22 is engaged with the rear surface (left surface in FIG. 3) of the lock portion 15. The connector housings 10, 20 are locked in their properly engaged state by this engagement of the projection 22 and the lock portion 15. When the lock arm 21 is deformed downwardly by pressing an operable portion 23 at the leading end of the lock arm 21, the projection 22 is disengaged from the lock portion 15, thereby permitting the disengagement of the connector housings 10, 20.

Below the lock arm 21 is formed a receiving space 24 for receiving the detection terminals 13 of the connector housing 10. The receiving space 24 is partitioned from a deformation permitting space 26 of the lock arm 21 by a partition wall 25 that extends approximately ⅔ of the length of the lock arm 21 from the base end of the lock arm 21 (front end of the female connector housing 20 with respect to a coupling or insertion direction A of the connector housings 10, 20; FIG. 1) toward the leading end thereof (rear end of the female connector housing 20 with respect to the coupling direction A). A space before the receiving space 24 is a communication space 27 which communicates with the rear end surface of the female connector housing 20 and the deformation permitting space 26 of the lock arm 21.

Below the receiving space 24 is provided a terminal receptacle 28 for holding and accommodating the short-circuiting terminal fitting 30. The terminal receptacle 28 extends substantially over the entire length of the female connector housing 20 from its front end to its rear end, and communicates with the receiving space 24 and the communication space 27. The terminal receptacle 28 has a substantially flat lower surface, and a fitting portion 29, into which the short-circuiting terminal fitting 30 is fitted, is formed at a front end thereof.

The short-circuiting terminal fitting 30 is particularly formed by bending a conductive metal plate which is punched into a specified shape. The short-circuiting terminal fitting 30 has a substantially flat platelike base portion 31. A front end portion (right end portion in FIGS. 5 and 6) of the base portion 31 is folded back and put together with the upper surface of the short-circuit terminal fitting. A pair of elastic contact portions 32 extend rearward from the fold-back portion of this front end portion. Each elastic contact portion 32 is fixed at one end thereof with the other end thereof hanging as a free end.

A large area of the base portion 31 except the front end portion is substantially lower than the front end portion so as to ensure a large space for the deformation of the elastic contact portions 32.

The free end of each elastic contact portion 32 is bent obliquely downwardly after being bent obliquely upwardly so as to incline forwardly, thereby forming a triangular pressing portion 33. The lock arm 21 presses this pressing portion 33 substantially from above. Since the pressing portion 33 is folded such that ends 33A of the pressing portions 33 are in contact with the upper surfaces of the elastic contact portions 32, a pressing force of the lock arm 21 can be effectively transmitted to the elastic contact portions 32. Further, since a rear bent surface 33B of the pressing portion 33 is obliquely inclined forward with respect to the coupling or insertion direction A (FIG. 1), a force generated by an other member contacting the pressing portion 33 from behind is diverted upwardly. In positions adjacent or before the pressing portions 33 are formed contact portions 34 which come into contact with the detection terminals 13 when the connector housings 10, 20 are properly engaged.

The short-circuiting terminal fitting 30 is provided with a protection wall 35 for protecting the elastic contact portions 32. The protection wall 35 is comprised of side walls 35A extending substantially vertically from the opposite side edges of a rear end portion of the base portion 31 and a rear wall 35B extending substantially vertically from the rear edge of the base portion 31 with respect to the coupling direction A. Projections 36A provided at the rear edges of both side walls 35A are engaged with recesses 36B at the opposite side edges of the rear wall 35B to more securely position the side walls 35A and the rear wall 35B with respect to the base portion 31. The side walls 35A are positioned at the sides of the free ends of the elastic contact portions 32 and the rear wall 35B is located behind the free ends of the elastic contact portions 32, so that the protection wall 35, as a whole, substantially surrounds the free ends of the elastic contact portions 32.

The height of the protection wall 35 is set slightly higher than that of the free ends of the elastic contact portions 32, and the pressing portions 33 project upward from the protection wall 35. The pressing portions 33 are displaced downwardly by being pressed by the lock arm 21 such that the pressing portions 33 are concealed within the protection wall 35. At this time, a degree of elastic deformation of the elastic contact portions 32 caused by the downward displacement of the pressing portions 33 is below an elasticity limit thereof. In this state, the lock arm 21 comes into contact with the upper edge of the protection wall 35 (FIG. 4), with the result that any further downward deformation of the elastic contact portions 32 can be prevented.

Next, the action of this embodiment is described.

While the short-circuiting terminal fitting 30 is handled alone before being mounted in the female connector housing 20, the leading ends of the elastic contact portions 32 are unlikely to get caught with each other or interfered by other member(s) since they are surrounded by the protection wall 35. Accordingly, it can be expected that the deformation of the elastic contact portions 32 be prevented.

In mounting the short-circuiting terminal fitting 30 in the female connector housing 20, the short-circuiting terminal fitting 30 is inserted into the terminal receptacle 28 through an opening formed in the rear end surface of the female connector housing 20. At this time, since the short-circuiting terminal fitting 30 can be stably held in its specified configuration by the base portion 31 sliding along the bottom surface of the terminal receptacle 28, it can be easily and securely inserted. If the protection wall 35 is pressed by finger or other means, the short-circuiting terminal fitting 30 can be easily pressed into the terminal receptacle 28.

Upon completion of the insertion when the front end portion of the base portion 31 is fitted into the fitting portion 29 of the terminal receptacle 28, lock portions 37 formed at the side edges of the base portion 31 cut in the side walls of the terminal receptacle 28, with the result that the short-circuiting terminal fitting 30 is so held as not to move in its withdrawal direction.

Even if a foreign matter enters the terminal receptacle 28 through the opening in the rear end surface of the female connector housing 20 while the short-circuiting terminal fitting 30 is mounted in the female connector housing 20, it comes into contact with the protection wall 35 instead of coming into direct contact with the elastic contact portions 32. Thus, the deformation of the elastic contact portions 32 due to the entrance of the foreign matter can be prevented.

Although there is a possibility that this foreign matter strikes against the bent surfaces 33B of the pressing portions 33 projecting upward of the protection wall 35, since the bent surfaces 33B are inclined forward, this striking force is diverted obliquely upward along the inclination of the bent surfaces 33B. Accordingly, a probability of damage to the elastic contact portions 32 can be reduced.

Further, when an other member strikes against the operable member 23 of the lock arm 21, the lock arm 21 may be deformed to a larger extent than when the connector housings 10, 20 are partly engaged, thereby excessively pressing the elastic contact portions 32. However, as shown by solid line in FIG. 4, the lock arm 21 comes into contact with the upper edge of the protection wall 35, thereby preventing the elastic contact portions 32 from being deformed more than specified. Thus, an excessive deformation of the elastic contact portions 32 beyond their elasticity limit can be prevented.

Figure 2:
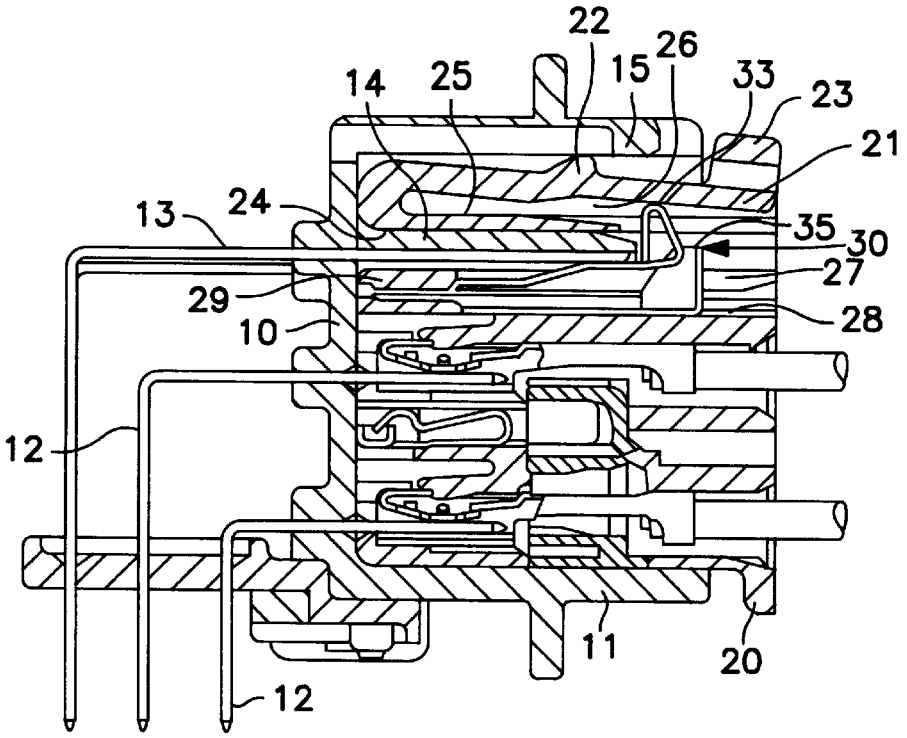
FIG. 2 is a section of the first embodiment when the connector housings are partly engaged.

When the connector housings 10, 20 are partly engaged, the elastically deformed lock arm 21 presses the pressing portions 33 downwardly as shown in FIG. 2, causing the elastic contact portions 32 to elastically deform. Accordingly, the contact portions 34 move away from the detection terminals 13. Since the detection terminals 13 are not short-circuited in this state, it can be known that the connector housings 10, 20 are partly engaged.

When the connector housings 10, 20 are properly engaged, the lock arm 21 elastically returns to its original position, freeing the pressing portions 33 as shown in FIG. 3. Accordingly, the elastic contact portions 32 are displaced upwardly due to their elastic restoring forces and the contact portions 34 thereof come into contact with the detection terminals 13 to short-circuit them. Thus, it can be known that the connector housings 10, 20 have been properly engaged.

As described above, according to this embodiment, since the short-circuiting terminal fitting 30 is provided with the protection wall 35, the deformation of the elastic contact portion 32 due to the interference by other member(s) can be prevented and an excessive deformation thereof due to the excessively pressed lock arm 21 can be prevented.

Figure 7A:
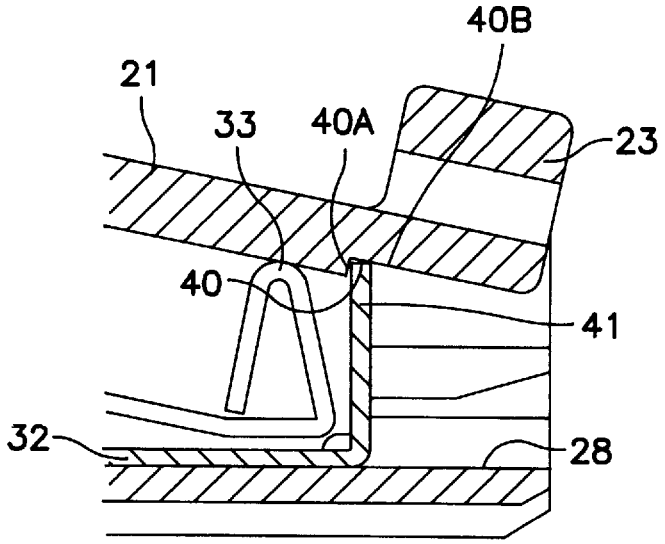
FIG. 7(A) is an enlarged partial section showing a state of a second embodiment where an excessive deformation of elastic contact portions due to the pressing displacement of a lock arm is prevented.

The second embodiment as shown in FIG. 7 (A) differs from the first embodiment in the construction of the lock arm and protection wall. Since the other construction is same or similar as that of the first embodiment, no description is given on the same construction as well as its action and effects by identifying it by the same reference numerals.

A bottom surface of a lock arm 21 according to the second embodiment is cut away to form a step acting as an inclination preventing portion 40. A protection wall 41 is higher than the protection wall 35 according to the first embodiment, and is engageable with the inclination preventing portion 40.

When the lock arm 21 is deformed to a larger extent than the deflection sufficient for the connector housings to be partly engaged, the inclination preventing portion 40 of the lock arm 21 comes into engagement with the upper edge of the protection wall 41. In this state, the upper edge of the protection wall 41 is in contact with an angular corner portion of the inclination preventing portion 40 and, accordingly, the protection wall 41 is prevented from displacing to the left and right of FIG. 7 by the transition surface 40A and the bottom surface 40B being positioned in particular obliquely or in a slanted manner with respect to the distal end of the protection wall 41, when the lock arm 21 is deflected downwardly. This securely prevents the protection wall 41 from inclining to the left or right even if the lock arm 21 strongly strikes against the protection wall 41.

Figure 7B:
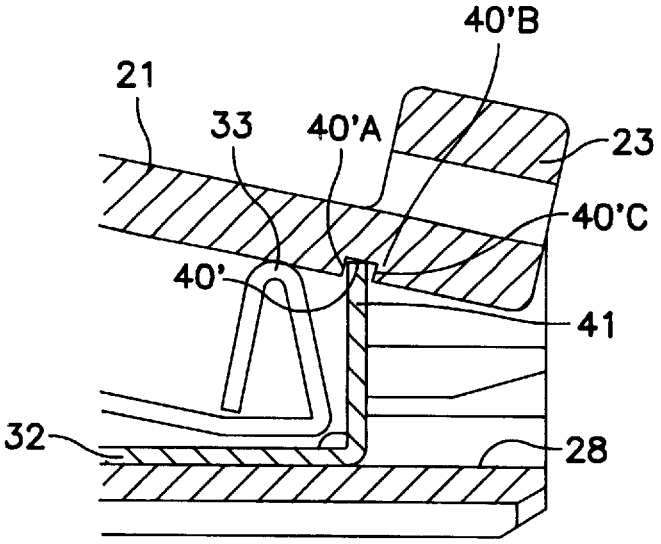
FIG. 7(B) is an enlarged partial section showing a state of a third embodiment where an excessive deformation of elastic contact portions due to the pressing displacement of a lock arm is prevented.
Figure 8:
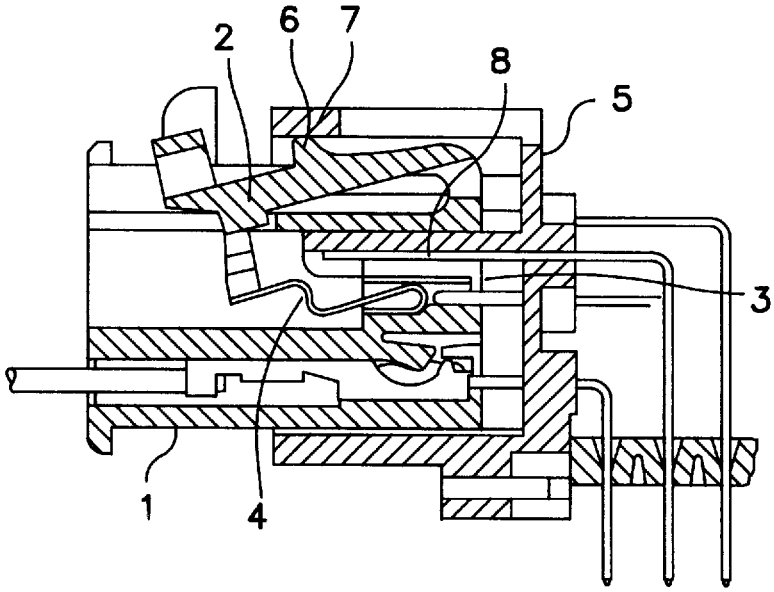
FIG. 8 PRIOR ART
FIG. 8 is a section of a prior art connector in its partly engaged state.
Figure 9:
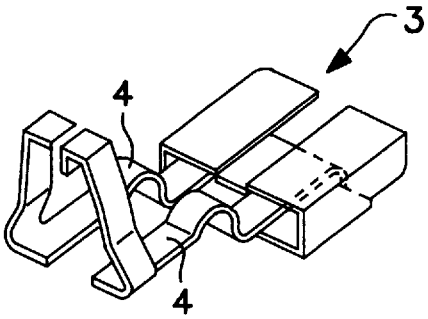
FIG. 9 PRIOR ART
FIG. 9 is a perspective view of a prior art short-circuiting terminal fitting.

The inclination preventing portion may be a recess, as shown in FIG. 7(B), wherein the protection wall 41 is fitted or inserted into a recess 40', when the lock arm 21 is deflected and interacts with the limiting surfaces 40'A–40' C, thereby limiting the downward deflection of the lock arm 21 and therefore of the elastic contact portions 32 and furthermore preventing a further displacement of the lock arm 21, preferably in any direction except the direction to its resting position in the undeflected state.

The present invention is not limited to the described and illustrated embodiments. For example, the following embodiments are embraced by the technical scope of the present invention as defined in the claims. Besides the following embodiments, a variety of changes can be made without departing the spirit and scope of the present invention as defined in the claims.

In the foregoing embodiments, description is given on a case where the short-circuiting terminal fitting is mounted in the female connector housing provided with the lock arm. However, according to the invention, the short-circuiting terminal fitting may be mounted in a connector housing which is not provided with a lock arm.

Although an excessive deformation of the elastic contact portions is prevented by the lock arm coming into contact with the protection wall in the foregoing embodiments, the protection wall may not have a function of preventing an excessive deformation of the elastic contact portions according to the invention.

In the foregoing embodiments, description is given on the construction in which the elastic contact portions are folded back from the flat platelike base portion. However, according to the invention, the base portion on which the elastic contact portions are supported may not be flat platelike, but of another suitable shape.

In the foregoing embodiments the deflection of the elastic contact portion 32 was performed by its interaction with the lock arm 21 being deflected. However there may be provided a deflection means other than a lock arm 21 such as a slanted projection (not shown) provided on the housing 10 capable of deflecting downward the elastic contact portion 32 upon coupling of the two connector housing 10, 20, thereby interrupting the electrical contact between the short-circuit terminal 30 and the detection terminals 13 in a partly engaged state of the connector housings 10, 20 and allowing for electrical contact between the short-circuit terminal 30 and the detection terminals 13 thereby short-circuiting them in an engaged state of the connector housings 10, 20.

What is claimed is:

1. A short-circuiting terminal fitting mountable in a first connector housing for selectively contacting each of a pair of detection terminals in a second connector housing, said short-circuit terminal fitting being provided with a base having first and second ends, an elastic contact portion having a first end fixed at the first end of the base and a second end of the elastic contact portion being disposed between the first and second ends of the base, the second end of the elastic contact portion being spaced a selected distance from the base in an undeflected condition of the elastic contact portion and being deflectable toward the base by a deflection means provided in said first connector housing, a protection wall being provided substantially around the deflectable second end of the elastic contact portion and extending from said base a distance greater than the selected distance to protect the deflectable second end of the elastic contact portion from inadvertent contact in both deflected and undeflected conditions of the elastic contact portion, the elastic contact portion being deflected by the deflection means out of contact with at least a pair of detection terminals to be mounted in the second connector housing when the pair of connector housings are partly engaged, and the elastic contact portion being releasable from deflection by the deflection means for contacting and short-circuiting the detection terminals when the connector housings are properly engaged, so that an engaged state of the pair of connector housings can be detected based on a short-circuited state of the detection terminals.

2. A short-circuiting terminal fitting according to claim 1, wherein the deflection means comprises a lock arm which locks the pair of connector housings in their engaged state, the elastic contact portion being operable together with the lock arm and being deflected by being pressed by the lock arm.

3. A short-circuiting terminal fitting according to claim 1, wherein the protection wall is dimensioned for preventing an excessive deformation of the elastic contact portion by the deflection means when the deflection means is moved.

4. A short-circuiting terminal fitting according to claim 1, wherein the base portion is substantially planar, the elastic contact portion being unitary with and folded back from the first end of the substantially planar base portion toward the other end, and wherein at least a portion of the protection wall extends unitarily from the second end of the base portion.

5. A short-circuiting terminal fitting according to claim 1, wherein the deflection means comprises an inclination preventing portion for preventing an inclination of the deflection means along a coupling direction of the connector housings in a direction substantially normal to the coupling direction of the connector housings by coming into contact with the protection wall.

6. A short-circuiting terminal fitting according to claim 1, wherein the protection wall comprises an end protection wall projecting orthogonally from the base at the second end thereof and a pair of side projection walls projecting orthogonally from opposed sides of the base from a location substantially at the second end of the base to a location between the first and second ends of the base, said end protection wall and at least portions of said side protection walls extending from the base a distance greater than the selected distance.

7. A short-circuiting terminal fitting according to claim 5, wherein the inclination preventing portion comprises a step provided in the deflection means.

8. A connector provided with an engagement detecting function, comprising:

first and second connector housings engageable with each other, the second connector housing having a deflection arm disposed for deflection during engagement of the connector housings and returning toward an undeflected condition upon complete engagement of the connector housings;

a pair of detection terminals mounted in the first connector housing; and a short-circuit terminal fitting mounted in the second connector housing and provided with a base having opposed first and second ends, an elastic contact portion having a first end fixed at the first end of the base, the elastic contact portion having a second end that is deflectable toward the second end of the base in response to movement of the deflection arm of the second connector housing, the second end of the elastic contact portion being spaced a selected distance from the base when the elastic contact portion is in an undeflected condition, a protection wall being provided substantially around the deflectable second end of the elastic contact portion and projecting from the base a distance greater than the selected distance for protecting the second end of the elastic contact portion in both a deflected and undeflected condition of the elastic contact portion, the short-circuit terminal being brought out of contact with the detection terminals by the elastic contact portion being deflected by the deflection arm when the pair of connector housings are partly engaged and short-circuiting the detection terminals when the elastic contact portion is released from the deflection by the deflection arm and coming into contact with the detection terminals when the connector housings are properly engaged, so that an engaged state of the pair of connector housings can be detected based on a short-circuited state of the detection terminals.

9. A connector according to claim 8, wherein the detection terminals are supported in the first connector housing and reinforced by a rib projecting from the first connector housing and arranged along at least a portion of the detection terminals.

10. A connector according to claim 8, wherein the at least one protection wall comprises an end protection wall projecting orthogonally from the second end of the base and a pair of side protection walls projecting orthogonally from opposed sides of the base and from the end protection wall, the end protection wall and at least portions of the side protection walls projecting from the base a distance greater than the selected distance such that the second end of the elastic contact portion is partly surrounded by the protection walls in both a deflected and undeflected condition of the elastic contact portion.

11. A connector according to claim 9, wherein the deflection arm of the second connector housing comprises a lock arm configured for interacting with a lock projection of the first connector housing and locking the connector housings in their engaged state, wherein the lock arm is deflectable in a deformation permitting space provided in the second connector housing.

* * * * *